US007004071B2

(12) United States Patent
Avetisian et al.

(10) Patent No.: US 7,004,071 B2
(45) **Date of Patent: *Feb. 28, 2006**

(54) INITIATOR WITH AN INTERNAL SLEEVE RETAINING A PYROTECHNIC CHARGE AND METHODS OF MAKING SAME

(75) Inventors: Vahan Avetisian, Newbury Park, CA (US); Andrew Bonas, Simi Valley, CA (US); Todd Rosin, Simi Valley, CA (US); Eishi Kajita, Westlake Village, CA (US)

(73) Assignee: Special Devices, Inc., Moorpark, CA (US)

( * ) Notice: Subject to any disclaimer, the term of this patent is extended or adjusted under 35 U.S.C. 154(b) by 23 days.

This patent is subject to a terminal disclaimer.

(21) Appl. No.: 10/903,660

(22) Filed: Jul. 29, 2004

(65) Prior Publication Data

US 2005/0115434 A1 Jun. 2, 2005

Related U.S. Application Data

(63) Continuation of application No. 10/188,003, filed on Jul. 1, 2002, now Pat. No. 6,848,365, which is a continuation-in-part of application No. 09/733,755, filed on Dec. 8, 2000, now Pat. No. 6,578,487.

(51) Int. Cl.
*F42B 3/10* (2006.01)
*F42C 19/12* (2006.01)

(52) U.S. Cl. ..... 102/202.7; 102/202.5; 102/202.9; 102/530

(58) Field of Classification Search ..... 102/202.7, 102/202.5, 202.9, 530
See application file for complete search history.

(56) References Cited

U.S. PATENT DOCUMENTS

| | | | | |
|---|---|---|---|---|
| 3,128,703 | A | 4/1964 | Bryan | 102/202.14 |
| 4,156,390 | A | 5/1979 | Ferguson et al. | 102/202.8 |
| 5,140,906 | A | 8/1992 | Little et al. | 102/202.14 |
| 5,433,147 | A | 7/1995 | Brede et al. | 102/202.2 |
| 5,686,691 | A | 11/1997 | Hamilton et al. | 102/202.5 |
| 5,988,069 | A | 11/1999 | Bailey | 102/202.9 |
| 6,009,809 | A | 1/2000 | Whang | 102/202.7 |
| 6,338,500 | B1 | 1/2002 | Perotto | 102/202.5 |
| 6,343,000 | B1 | 1/2002 | Yokoyama et al. | 102/202.5 |
| 6,446,557 | B1 | 9/2002 | Lubbers | 102/202.9 |
| 6,487,972 | B1 | 12/2002 | Cook et al. | 102/202.8 |

*Primary Examiner*—Michael J. Carone
*Assistant Examiner*—James S. Bergin
(74) *Attorney, Agent, or Firm*—Law Offices of Thomas J. Brindisi

(57) ABSTRACT

A pyrotechnic initiator having an internal sleeve that facilitates the loading and durable retention of a pyrotechnic charge in place on the header surface within the initiator. The sleeve beneficially retains the charge either in conjunction with the upper interior surface of the charge can, or through the use of a monolithic charge and a narrowed top end of the sleeve.

20 Claims, 5 Drawing Sheets

INITIATOR WITH AN INTERNAL SLEEVE RETAINING A PYROTECHNIC CHARGE AND METHODS OF MAKING SAME

RELATED APPLICATION

This application is a continuation of U.S. application Ser. No. 10/188,003 by Avetisian et al., which was filed on Jul. 1, 2002 and entitled "Pyrotechnic Initiator with a Narrowed Sleeve Retaining a Pyrotechnic Charge and Methods of Making Same," and issued as U.S. Pat. No. 6,848,365 on Feb. 1, 2005, which was in turn a continuation-in-part of U.S. application Ser. No. 09/733,755 by Avetisian et al., filed on Dec. 8, 2000 with the same title and issued as U.S. Pat. No. 6,578,487 on Jun. 17, 2003, which is incorporated herein by reference except to the extent that it contradicts anything explicitly set forth here.

BACKGROUND OF THE INVENTION

The present invention generally relates to the field of pyrotechnic initiators, and more particularly to a pyrotechnic initiator having an internal sleeve retaining a pyrotechnic charge.

Pyrotechnic initiators have many uses in industrial and consumer applications. One important use is in triggering the inflation of airbags in motor vehicles. Significant efforts have been made in the automotive industry to reduce the cost of manufacturing reliable airbag initiators. One advance has been the use of liquids and slurries in loading pyrotechnic charges into the initiators. As shown in U.S. Pat. No. 5,686,691 to Hamilton et al., it is known to load a slurry charge into a conventionally cup-shaped charge can, and to directly affix such a loaded can onto a header assembly so that the charge comes into contact with the header surface and bridgewire. However, this method poses certain drawbacks and difficulties and limits the available range of slurries since the slurry must be amenable to consolidation. It is believed that hitherto a thin-walled, rigid charge sleeve has not been used to facilitate the loading and durable retention of a pyrotechnic charge in place on the header surface within an initiator.

SUMMARY OF THE INVENTION

In accordance with the present invention, an initiator includes an internal charge sleeve that is loaded with a pyrotechnic charge such as through slurry loading. The sleeve is closed at its bottom end by the initiator's header assembly, but has an open top end. The charge sleeve beneficially retains the charge on the header of the initiator, either in conjunction with the upper interior surface of the charge can, or through the use of a monolithic charge and a narrowed top end of the sleeve.

DETAILED DESCRIPTION OF PREFERRED EMBODIMENTS[1]

Figure 1:
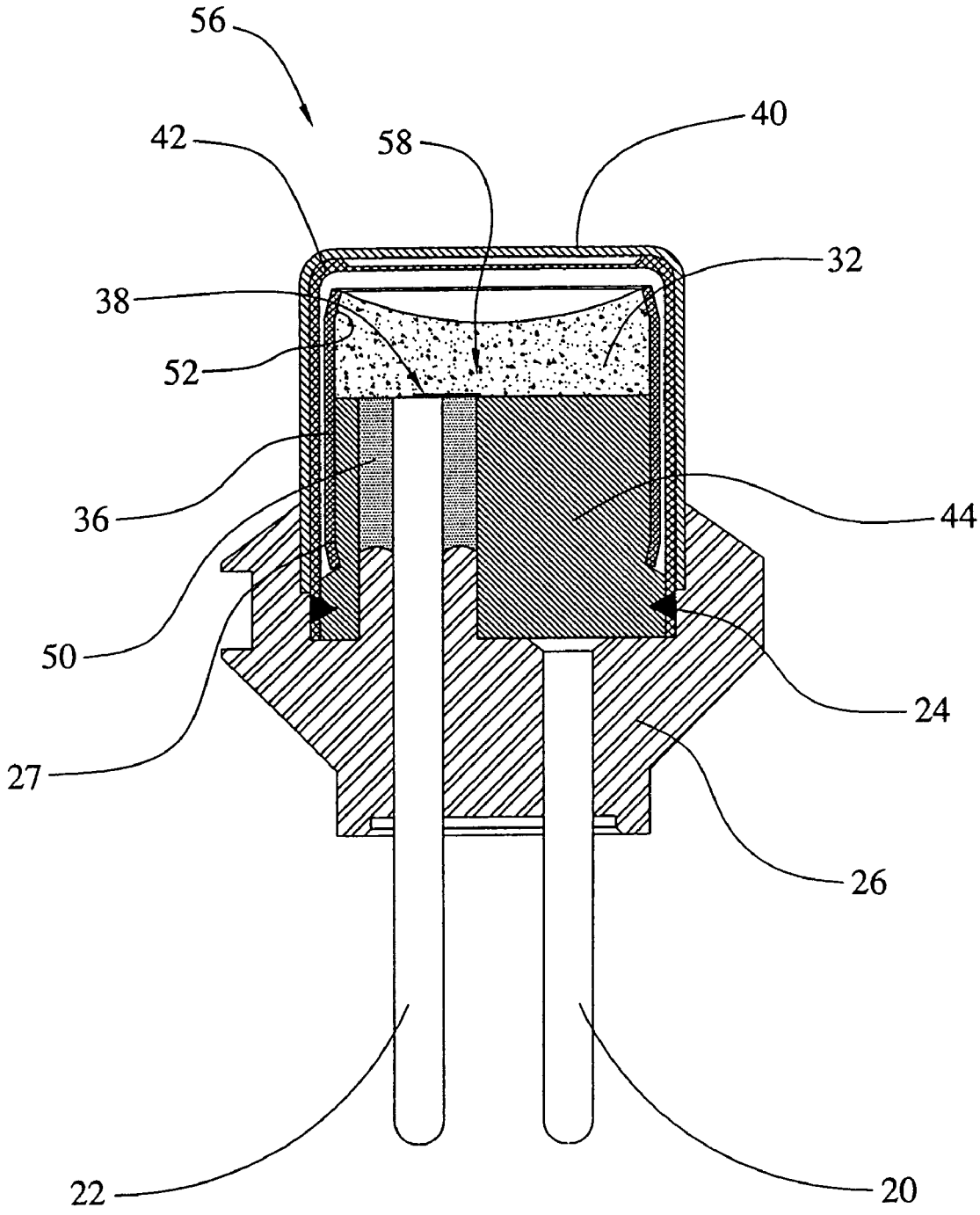
FIG. 1 is a side sectional view of a narrowed sleeve embodiment of an initiator according to the present invention.

Various initiator configurations can be used, or modified appropriately for use, in the present invention. As can be seen from FIG. 1, a preferred embodiment of an initiator 56 according to the present invention preferably includes a number of features typically found in pyrotechnic initiators. For example, there is a glass-to-metal sealed header assembly 58 hermetically attached to a charge can 42 through a circumferential weld 24, an insulator cup 40, and a molded insulating body 26. The depicted header assembly 58 consists of an isolated center pin 22, glass 50, an eyelet 44, a welded bridgewire 38, and a ground pin 20, with both of the pins 20 and 22 extending beyond the body 26 to form a connector end. The eyelet 44 is preferably made of a metal such as 304L stainless steel, and is generally cylindrical with a passage defined through it to permit a feedthrough to be created by the hermetic sealing of the glass 50 and the center pin 22 therein. The depicted header assembly 58 includes an eccentrically placed passage, center pin and glass, however, they could alternately be concentrically placed, or the header could be non-coaxial with two pins each sealed in a feedthrough. The glass 50 may preferably consist of sodium aluminosilicate or barium alkali silicate, and the bridgewire 38 may be formed from a high resistance metal alloy such as platinum-tungsten or "NICHROME" nickel-chromium alloy. The charge 32 may preferably be zirconium/potassium perchlorate-based and is in a heat-receiving relationship with the bridgewire 38. A firing current having at least a predetermined "all-fire" level and duration (e.g., 800 mA for 2 milliseconds at −35° C.) applied to the pins 20 and 22 resistively generates heat that is reliably (e.g., 99.9999% of the time with at least 95% confidence) sufficient to ignite the charge 32. It is also generally required that the application of current up to a predetermined "no fire" level and duration (e.g., 200 mA for 10 seconds at 85° C.) will reliably not result in the bridgewire generating sufficient heat to ignite the charge 32. As an alternate to the bridgewire 38, a monolithic bridge may be used, and preferably consists of dissimilar conductive materials such as a thick resistive film on a ceramic substrate, a thin resistive film deposited on a ceramic substrate, or a semiconductor junction diffusion doped onto a silicon substrate, examples of each of which are well-known in the art.

[1] The present description incorporates by reference in full the disclosures of the following co-pending applications that are filed concurrently herewith and assigned to the assignee of the present application: Ser. No. 10/188,402, by Vahan Avetisian et al., Ser. No. 10/188,004, by Vahan Avetisian et al; Ser. No. 10/188,009by Marius Rosu and issued on Mar. 2, 2004 as U.S. Pat. No. 6,698,356; and Ser. No. 10/188,010by Vahan Avetisian. U.S. Pat No. 5,648,634 Avory et al. is also incorporated herein by reference.

In the embodiment of FIG. 1, a sleeve 36 having a cylindrical aspect contains the charge 32 within the initiator and retains it in place against the top surface of the header assembly 58, preferably so that it is in intimate contact with the bridgewire 38. This sleeve 36 can be formed, for example, from a hollow cylindrical piece of 304L stainless steel having a wall thickness of ten thousandths of an inch, which is then swaged inwardly (using a suitable special-formed tool designed for the application such as is well-known in the art) at its top to form a narrowed top end 52. The sleeve 36 can then be slid onto the header assembly 58 and its bottom end 27 can then be swaged inwardly along a suitable corresponding circumferential recess on the eyelet 44. The sleeve 36 preferably has a relatively tight interference fit with the header assembly 58 so as to secure it firmly thereto and reduce the likelihood of the charge 32 shifting. Approximately the upper half or third of the sleeve 36 preferably remains above the top surface of the header assembly 58. Other suitable methods, such as welding, can alternately or additionally be used to secure the sleeve.

Following that, preferably substantially the entire open area within the sleeve 36 (i.e., the area within the aforementioned upper half or third that remains above the top surface of the header assembly 58) is loaded with a suitable pyrotechnic charge 32. This is preferably done using a slurry loading technique or similar means known in the art. Some examples of relevant slurry-loadable pyrotechnic compositions are described in U.S. Pat. No. 5,686,691 to Hamilton, et al., the disclosure of which is incorporated herein by reference except to the extent that it contradicts anything explicitly set forth here. A suitable slurry for use in forming charge 32 in the present embodiment may include a binder such as Viton-B® preferably at less than five percent by weight, a solvent such as butyl acetate at approximately twenty percent by weight, and the balance preferably being zirconium/potassium perchlorate and any other desired additives.

Alternately, instead of pre-forming the sleeve's narrowed top end 52 prior to loading the charge 32, the upper end 52 of the sleeve 36 can be circumferentially crimped inwardly after (or while) the slurry dries, so that it becomes narrowed and compresses the charge 32.

Optionally, the top of the charge 32 can be pressed downwardly during or after drying of the slurry in order to pack it more tightly and more firmly press it against the bridgewire 38. Although such pressing is preferably done in such a way as to produce a concave top on the charge 32 (as shown in FIG. 1), the top of the charge 32 could alternately be formed substantially flat or even project convexly above the top of the sleeve 36 (similar to the depiction in FIG. 5).

Although the sleeve 36 is preferably loaded after it is attached to the header assembly as just described, the sleeve 36 could alternately be separately pre-loaded (preferably with a slurry, and preferably upside-down on a flat surface or suitable fixture) with the charge 32 (so as to fill the desired portion of the upper region of the sleeve 36). Then, preferably after substantial or complete drying of the slurry, the header assembly 58 could be slid into the sleeve 36 such that the charge 32 makes intimate contact with the bridgewire 38. This would preferably be done with the sleeve 36 pre-formed with its narrowed top end 52, and with the application of sufficient pressure on the header assembly 58 against the charge 32 so as to increase the degree of contact therebetween.

In any case, when the sleeve with its narrowed top end 52 is in place on the header assembly and the slurry is dried, the charge 32, which is a monolithic solid mass, is physically retained in place on the top surface of the header assembly 58 by the sleeve 36. Specifically, the obstruction of the narrowed top end 52 (which has a smaller inner diameter than the outer diameter of charge 32 below narrowed top end 52), and possibly also the cohesion and/or friction between charge 32 and the walls of sleeve 36, retain charge 32 in intimate contact with bridgewire 38 (or other suitable electrical initiating element). Thus, the process of assembling the pyrotechnic charge 32 to the header assembly 58 in intimate contact with the bridgewire 38 is simplified and yet more reliable.

Subsequently, the resulting initiator subassembly (including the header assembly 58 and the sleeve 36 loaded with the pyrotechnic charge 32) is pressed into and hermetically sealed and attached to the charge can 42 (which preferably may also be 304L stainless steel having a wall thickness of ten thousandths of an inch), such as with a through-weld 24. To complete the initiator 56, a suitable insulator cup 40 (which preferably may be nylon having a wall thickness of ten thousandths of an inch) and insulating body 26 (which may preferably be nylon insert-molded onto the initiator subassembly) may be provided as is well known in the art.

It is noted that the intermediary containment provided by the sleeve 36 may also help insulate the charge 32 within the initiator 56 from external physical stresses such as vibrations, particularly if all (as shown in FIG. 1) or at least a substantial portion of the sleeve 36 is physically spaced apart from the interior of the can 42. This in turn enhances the robustness of the contact between charge 32 and bridgewire 38.

Figure 2:
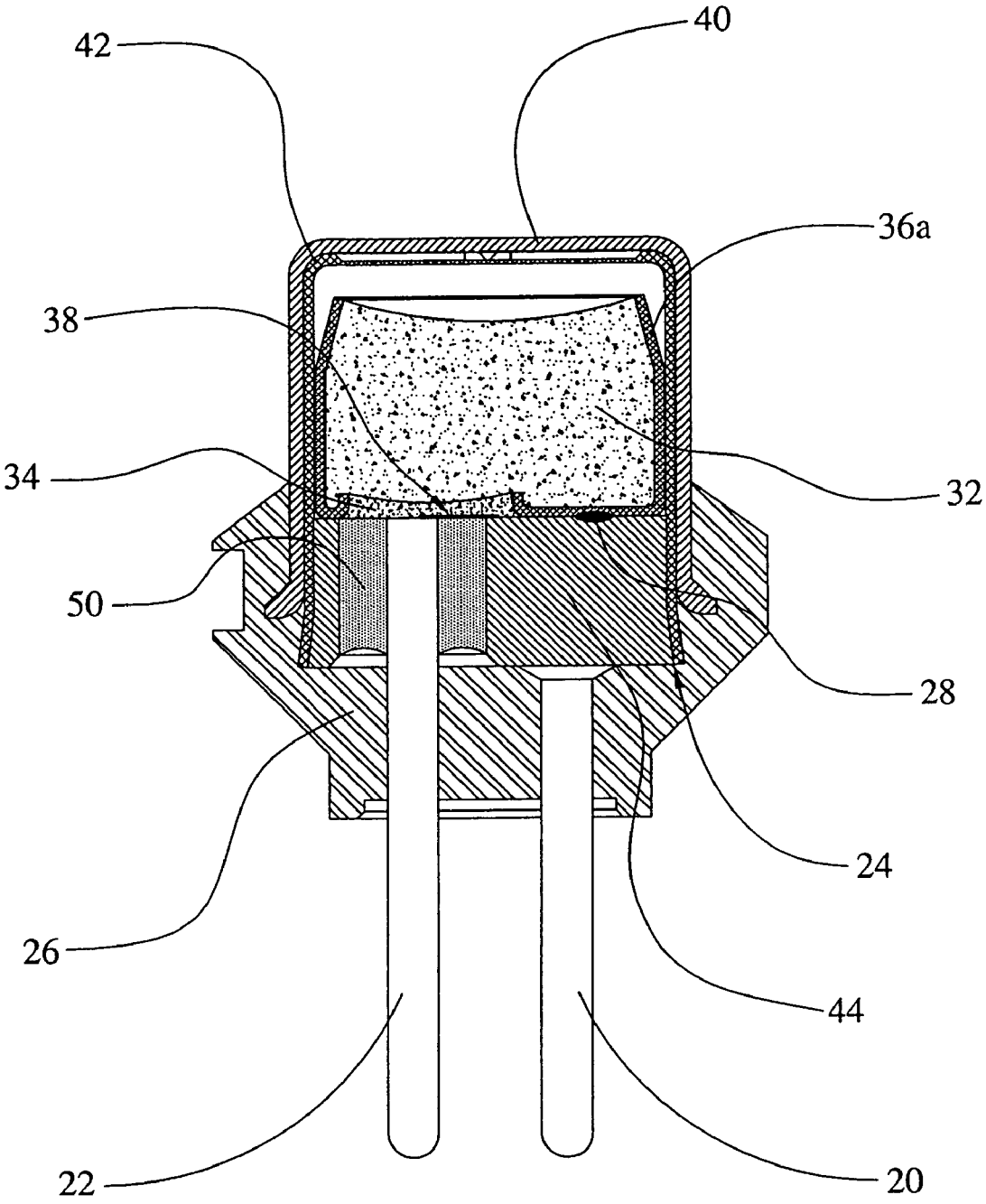
FIG. 2 is a side sectional view of an initiator having an alternate narrowed sleeve embodiment to that of FIG. 1.

Turning to FIG. 2, it will be apparent that many variations of a sleeve having a narrowed top end can be made. In this embodiment, instead of starting with a hollow cylindrical metal piece to form the sleeve 36, a cup-shaped metal piece can be used to form the sleeve 36*a*. A hole can then be punched or stamped out of the bottom of this cup, in a position corresponding to the feedthrough and bridgewire placement on the surface of the header assembly. The narrowed top end of the sleeve 36*a* can be formed as described above, either before or after the step of punching out the hole in the bottom of the sleeve 36*a*. Optionally, a circumferential upturned rim can be formed (again using a suitable special-formed tool) onto the edge of the hole in the bottom of the sleeve 36*a*, and can beneficially serve as a dam to help locate the loading of, and to retain in contact with the bridgewire 38, a primer charge 34 that is distinct from the (output) charge 32. In the embodiment depicted, a preferable height for such a rim is ten thousandths of an inch. Stainless steel 304L having a wall thickness of ten thousandths of an inch is again suitable for such a sleeve. The sleeve 36*a* is preferably resistance welded at weld 38 to the top surface of the header assembly, although it can also be TIG-welded, laser welded, glued, or attached by any other suitable means. Using the dam created by the circular rim at the bottom of the sleeve 36*a*, a suitable primer charge 34 may be loaded, preferably in a slurry form, and then output charge 32 may be loaded generally as described above with reference to FIG. 1. A suitable primer charge 34 may be a slurry including a binder such as Nipol® AR53L preferably at a few tenths of a percent by weight, a solvent such as butyl acetate at approximately twenty percent by weight, and the balance preferably being zirconium/potassium perchlorate and any other desired additives. The binder in the ignition charge 34 preferably has an extremely high coefficient of elasticity, such as 1000%, and is preferably extremely adhesive so as to strongly bind to the bridgewire. In a preferred embodiment having a total charge weight of 260 mg, the primer charge 34 may preferably have a weight of 30 mg.

It is also noted that although the foregoing description of the embodiments of FIGS. 1 and 2 refer to the use of a dried slurry charge, any other charge may be used that results in a monolithic mass retained on the header top surface by the narrowed upper end of the sleeve.

Figure 3:
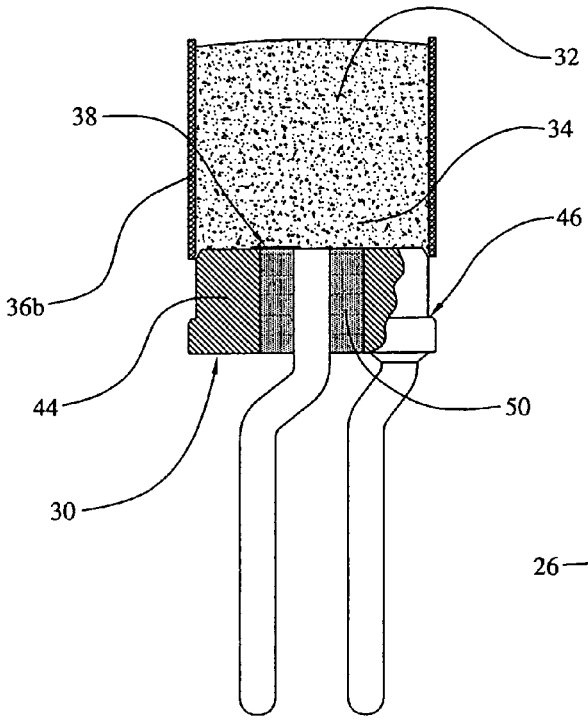
FIG. 3 is a partial side sectional view of a straight sleeve embodiment of the invention, showing the loaded sleeve placed on the header assembly, ready for the charge can to be placed thereon.
Figure 4:
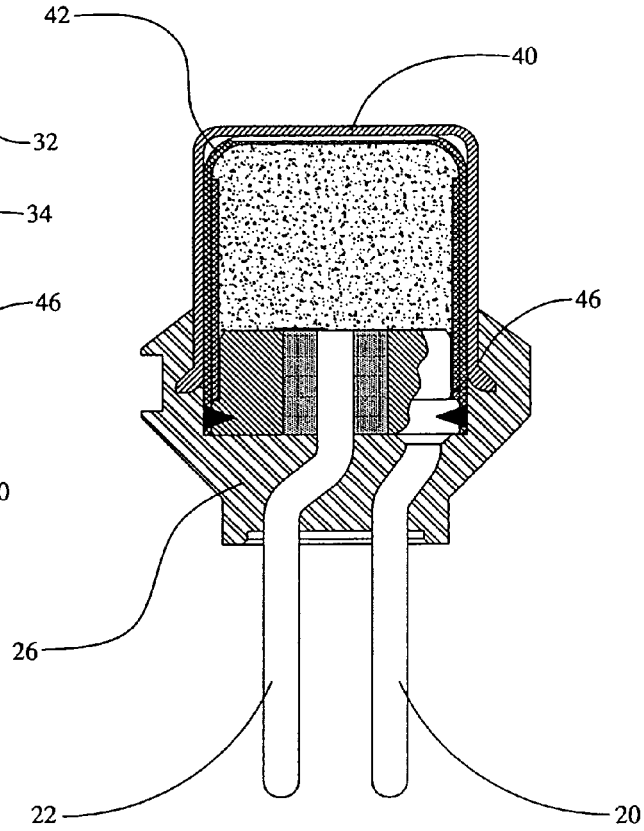
FIG. 4 is a side sectional view of the embodiment of FIG. 3, after the charge can has been pressed down on top of the sleeve, sliding the sleeve fully onto the header assembly.

Next, FIGS. 3 and 4 show an alternate embodiment of the invention that employs a straight sleeve rather than a sleeve with a narrowed top end. FIG. 3 shows the loaded sleeve 36*b* placed on the header assembly 30, ready for the charge can to be placed thereon; FIG. 4 shows the initiator after the charge can has been pressed down on top of the sleeve, causing the the sleeve to slide fully onto the header assembly 30. This embodiment may preferably be similar to those of FIGS. 1 and 2, with the main distinction being that the sleeve 36*b* does not need a narrowed top end, because the open top of the sleeve is closed off by the interior upper surface of the charge can 42, thus retaining the charge 32 (preferably with a distinct primer charge 34) firmly in place on the top surface of the header assembly 30.

In this embodiment, the sleeve 36*b* can be placed on top of the header assembly 30 as depicted so that the bottom of the sleeve meets the outer circumferential edge of the header assembly 30, and then loaded with charge (or less preferably the sleeve 36*b* can be loaded prior to placing it on the header assembly 30). Then, the charge can 42 is placed over the loaded sleeve 36*b*, and pressed downwardly thereover. As it is pressed downwardly, the friction of the interference fit between the charge can 42 and the sleeve 36*b* and/or the closed top end of the can 42 cause the sleeve 36*b* to slide downwardly until it hits shoulder 46. The can 42 is preferably pressed onto the header assembly 30 so as to exert a consolidation force downwardly on the charge, preferably of 5000 psi. It is noted that an appropriate length for the sleeve 36*b* is dictated largely by the distance from shoulder 46 to the top surface of the header assembly 30, and the anticipated length of compression of the charge that will occur when the consolidation force is applied. The can 42 is then attached to the header assembly 30 such as by a circumferential through-weld to the eyelet 44, or a through-weld (not shown) going through both the can 42 and sleeve 36*b* to the eyelet 44. The shoulder 46 may be omitted if both the can and sleeve are welded to the eyelet 44.

Figure 5:
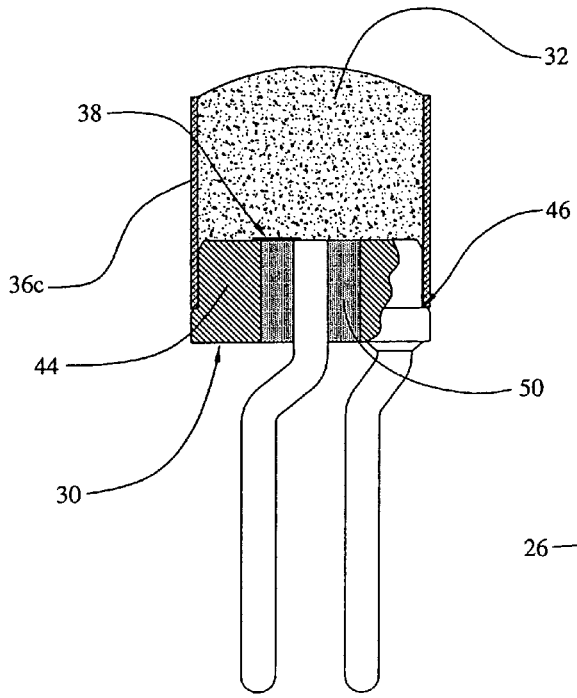
FIG. 5 is a partial side sectional view of an alternate straight sleeve embodiment to that of FIGS. 3 and 4, showing the loaded sleeve placed on the header assembly, ready for the charge can to be placed thereon.
Figure 6:
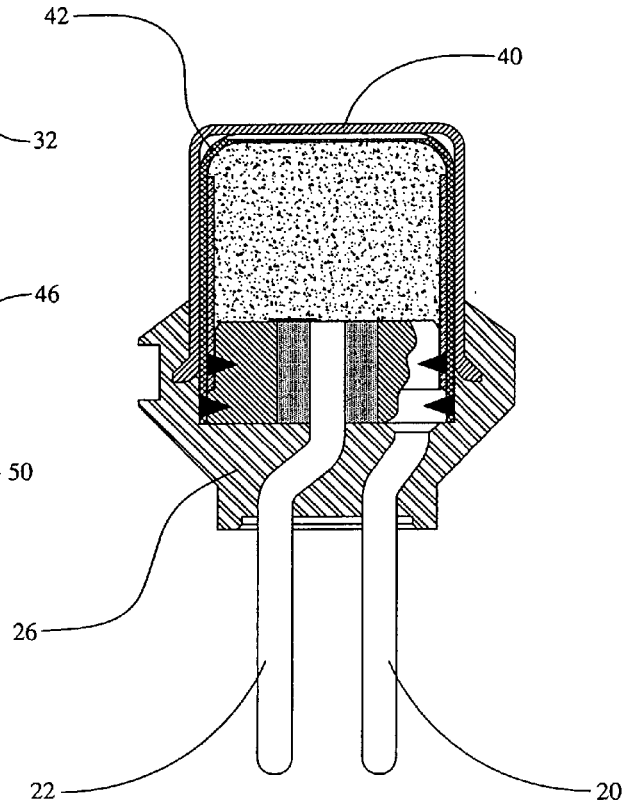
FIG. 6 is a side sectional view of the embodiment of FIG. 5, after the charge can has been pressed down on top of the sleeve.

Next, FIGS. 5 and 6 show an embodiment of the invention that is similar to that depicted and described above with reference to FIGS. 3 and 4, but which employs a straight sleeve 36*c* that is fully inserted onto the header assembly 30 before the can 42 is placed on the assembly. In this embodiment, the sleeve 36*c* is preferably inserted onto the header assembly 30 and then loaded with charge (although this could less preferably occur in reverse order) such that a mound of charge is formed at the top of the sleeve 36*c*, protruding above the top of the sleeve. Then the charge can 42 is pressed down on top of the sleeve 36*c*, preferably with at least enough force to cause the mound of charge to flatten out and generally conform to the upper interior surface of the charge can 42. The charge can 42 is further preferably pressed with enough force to cause desirable consolidation of the charge applied, in which case the height of the charge mound above the top of the sleeve should be sufficiently large (or conversely, assuming the charge weight is predetermined, the height of the sleeve 36*c* should be sufficiently low) that the charge can is not obstructed by the top of the sleeve 36*c* before desirable charge consolidation is attained. As an example, with a 260 mg total charge, using a slurry as described above, a suitable sleeve 36*c* may have a diameter of 6.6 mm and a height of 7.0 mm, with a distance of 4.0 mm from the top surface of the header assembly 30 to the shoulder 46, and a suitable height of the charge mound may be forty to a hundred thousandths of an inch.

Figure 7:
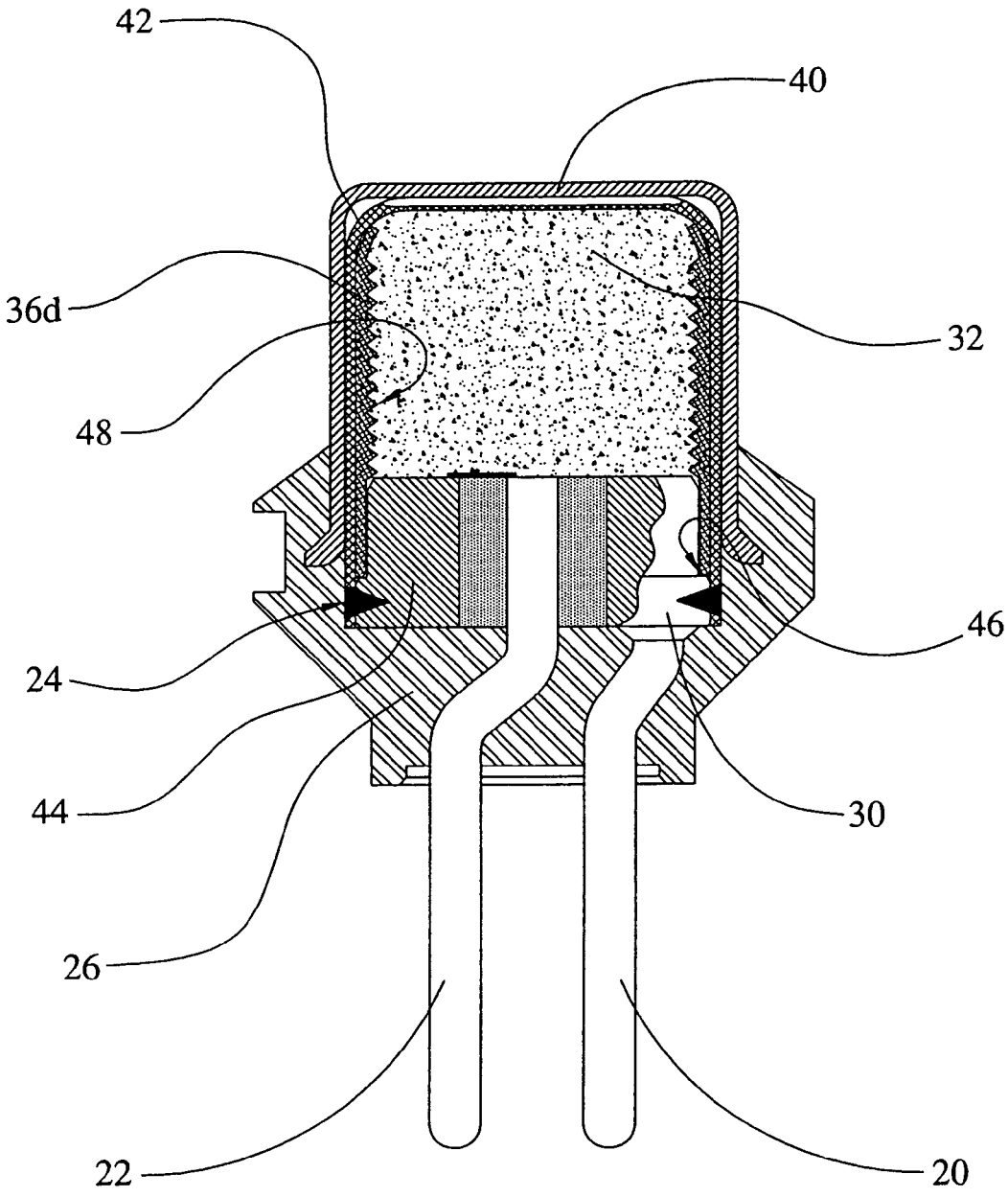
FIG. 7 is a side sectional view of an alternate straight sleeve embodiment that is similar to the embodiments of FIGS. 3–6, except that the sleeve is readily deformable when the can is pressed down on top of it.

To the extent that it is difficult in a particular configuration to attain a charge mound that is sufficiently raised above the top of the sleeve, the alternate deformable straight sleeve embodiment depicted in FIG. 7 may be used to address the difficulty. This deformable straight sleeve 36*d* may be similar to the sleeve 36*c* of FIGS. 5 and 6, and may be applied to the header assembly 30 and loaded in similar fashion, except that the sleeve 36*d* is readily deformable when the can 42 is pressed down on top of it, permitting a further degree of compression of the charge 32. Such a deformable straight sleeve 36*d* can be made of plastic or paper, preferably with a wall thickness of approximately four to ten thousandths of an inch, and preferably with a "crumple zone" of perforations or the like provided along all or a portion of its length so that regular bends 48 will form when the can 42 is pressed downwardly on the loaded sleeve 36*d*, such bends 48 reducing the effective height of the sleeve 36*d*, and thus permitting the can 42 to continue to compress the charge 32 downwardly further.

It is also noted that in suitable embodiments of the invention, methods of loading such as those taught in assignee's co-pending application Ser. No. 10/188,009, by Marius Rosu and issued on Mar. 2, 2004 as U.S. Pat. No. 6,698,356, may be used. Also, the bridgewire 38 may preferably be in close contact with the glass 50, and/or may be flattened, as is taught in assignee's co-pending application Ser. No. 10/188,010, by Vahan Avetisian. The bridgewire 38 may also preferably be in contact with the adjacent charge at a position of the charge that was subject to a relatively high degree of contraction during the slurry drying process, so as to minimize the presence of voids in the charge at that position, as taught in assignee's co-pending application Ser. No. 10/188,004, by Vahan Avetisian et al. Finally, a flat slip plane may be provided so as to minimize the physical and environmental stresses affecting the charge near the bridgewire 38, as taught in assignee's co-pending application Ser. No. 10/188,402, by Vahan Avetisian et al.

A preferred embodiment of a pyrotechnic initiator having a charge sleeve that facilitates the loading and durable retention of a pyrotechnic charge in place on the header surface within an initiator, has thus been disclosed. It will be apparent, however, that various changes may be made in the form, construction, and arrangement of the parts without departing from the spirit and scope of the invention, the form hereinbefore described being merely a preferred or exemplary embodiment thereof. Therefore, the invention is not to be restricted or limited except in accordance with the following claims.

What is claimed is:

1. A method for making an initiator, comprising the steps of:

a) providing a header assembly including an eyelet, a top surface, and an exposed electrical initiating element on said top surface;

b) providing a charge sleeve projecting upwardly above said top surface of said eyelet, wherein said charge sleeve has a top end that is not substantially narrowed;

c) loading a charge in the form of a liquid or slurry within said charge sleeve;

d) drying said liquid or slurry charge; and, e) attaching a charge can to said header assembly so as to surround said charge sleeve and said charge and hermetically separate said charge from the ambient environment exterior to said charge can.

2. The method of claim 1, wherein said charge sleeve is generally cup-shaped and includes a hole in its bottom, said method further comprising the step of attaching the bottom of said charge sleeve to the top surface of said header assembly.

3. The initiator made by the method of claim 2.

4. The method of claim 1, wherein said eyelet has an outer diameter and said charge sleeve has a lower region having an inner diameter that is approximately the same as said outer diameter of said eyelet, said method further comprising the step of sliding said charge can down over said charge sleeve after said charge sleeve is loaded with said charge.

5. The initiator made by the method of claim 4.

6. The method of claim 4, wherein said step of sliding continues until the upper interior surface of said charge can is in intimate contact with said charge and said charge is consolidated under a pressure of at least 1000 psi.

7. The method of claim 6, wherein said electrical initiating element is a bridgewire.

8. The initiator made by the method of claim 7.

9. The initiator made by the method of claim 6.

10. The method of claim 1, wherein said step of loading includes forming one or more protruding portions at the top of said charge, and flattening said one or more protruding portions against the upper interior surface of said charge can.

11. The initiator made by the method of claim 10.

12. The method of claim 1, wherein said eyelet includes a circumferential shoulder, said method further comprising the step of causing said charge sleeve to slide downwardly until it abuts said circumferential shoulder.

13. The initiator made by the method of claim 12.

14. The method of claim 1, wherein said eyelet has an outer diameter and said charge sleeve has a lower region having an inner diameter that is approximately the same as said outer diameter of said eyelet, said method further comprising the step of placing part of said eyelet within said lower region of said charge sleeve and circumferentially welding said charge sleeve to said eyelet.

15. The initiator made by the method of claim 14.

16. The method of claim 1, wherein said step e) includes positioning said charge can such that it is spaced apart from said charge sleeve.

17. The initiator made by the method of claim 16.

18. The method of claim 1, wherein step e) is performed before, during, and/or after step d).

19. The initiator made by the method of claim 18.

20. The initiator made by the method of claim 1.

* * * * *